US005981885A

United States Patent [19]

Katoh et al.

[11] Patent Number: 5,981,885

[45] Date of Patent: Nov. 9, 1999

[54] OPERATION-STAGGERED DUAL SWITCH

[75] Inventors: Yuichi Katoh; Hiroyuki Yahagi, both of Yokohama, Japan

[73] Assignee: Satori Electric Co., Ltd., Tokyo, Japan

[21] Appl. No.: 09/196,435

[22] Filed: Nov. 20, 1998

[30] Foreign Application Priority Data

| | | | |
|---|---|---|---|
| Nov. 26, 1997 | [JP] | Japan | 9-324333 |
| May 12, 1998 | [JP] | Japan | 10-128534 |
| Oct. 16, 1998 | [JP] | Japan | 10-295334 |

[51] Int. Cl.[6] ..... H01H 13/24

[52] U.S. Cl. ..... 200/1 B; 200/6 B; 200/529; 200/533; 200/437

[58] Field of Search ..... 200/1 R, 1 B, 200/6 R, 6 B, 6 BA, 16 R, 16 B, 16 C, 17 R, 78, 50.32, 50.37, 501, 520, 522, 521, 533, 537, 337, 338, 433, 437, 453

[56] References Cited

U.S. PATENT DOCUMENTS

| | | | |
|---|---|---|---|
| 4,286,125 | 8/1981 | Schaffeler et al. | 200/6 B |
| 5,600,107 | 2/1997 | Tsai | 200/1 R |
| 5,644,112 | 7/1997 | Geiger et al. | 200/1 R |
| 5,854,455 | 12/1998 | Cranick et al. | 200/1 B |

FOREIGN PATENT DOCUMENTS

| | | | |
|---|---|---|---|
| 63-28817 | 8/1988 | Japan | H01H 13/64 |
| 63-34176 | 9/1988 | Japan | H01H 7/03 |

*Primary Examiner*—Michael Friedhofer
*Attorney, Agent, or Firm*—Nikaido Marmelstein Murray & Oram, LLP.

[57] ABSTRACT

An operation-staggered dual switch is provided having a casing, first and second switching mechanisms installed in the casing, the switching mechanisms being operatively connected such that operation of the first switching mechanism may follow operation of the second switching mechanism after a predetermined delay, wherein the operation-staggered dual switch includes delay means comprising a connection rod having indentations formed on one side, a train of toothed wheels having a leading toothed wheel and a trailing toothed wheel, the leading toothed wheel of the train of toothed wheels being engaged with selected indentations of the connection rod, and a rotary damper connected to the trailing toothed wheel of the train of toothed wheels, the connection rod being responsive to initiation of operation of the first switching mechanism for moving in a given direction.

6 Claims, 15 Drawing Sheets

OPERATION-STAGGERED DUAL SWITCH

BACKGROUND OF THE INVENTION

1. Field of the Invention

The present invention relates to an operation-staggered dual switch whose first and second switching mechanisms are so designed that their turning "on" or actuation may be staggered in time, thereby for instance, preventing the flow of rush current in an electric motor when starting.

2. Description of Related Art

In starting the electric motor a heavy rush current flows therein in the instant switch is turned on (see FIG. 12). The rush current causes sparks to appear between the confronting contacts of the switch when these contacts bound, and the switch is liable to be defective in its contacts.

To prevent the flowing of such rush current two switches are operatively connected so that their turning "on" may be staggered. When the first switch turns on, a resistor, coil or controlling unit is put in circuit with the electric motor to prevent the flowing of rush current therein, and then the second switch turns on to exclude the resistor, coil or controlling unit, allowing the electric motor to continue running.

One example of a staggered type of composite switch is disclosed in Japanese Utility Model 63-28817(B). When depression of the actuating knob starts against a counter spring, which sits on a seesaw-like movable contact of the second switch, the seesaw-like movable contact is caught and restricted in motion by a spring-biased retainer in the form of a fulcrum. When the actuating knob advances a predetermined distance beyond the early throw position in which the first switch turns on, the retainer is yieldingly depressed to release the seesaw-like movable contact, and then it rushes to the throw position under the counter action of the spring on the actuating knob.

Another example of a staggered type of composite switch is disclosed in Japanese Utility Model 63-34176(B). The second switch to be thrown later has a seesaw-like lever, and the seesaw-like lever has a contact fixed to one end and a damper fixed to the other end. The damper has the effect of retarding the operation of the second switch, which is thrown later than the first switch. The damper is of a dust-tight structure.

As for the former staggered type of composite switch: the spring-biased retainer applies unstable force to the seesaw-like movable contact for restricting it in motion, and the resilient force applied by the counter spring to overcome the restriction is dependent on the strength of force with which the actuating knob is depressed. As a consequence, the time at which the movable contact is released is indefinite, and sometimes the movable contact cannot be released when associated parts do not work well. After repeating the switching action many times, associated parts are liable to be worn or changed in friction, thus causing their stagger actuation times to vary after long-termed use.

As for the latter staggered type of composite switch: to change the damping characteristics of the damper it is necessary that annular membranes and inter-membrane spacers be changed, and then, silicone grease may leak and scatter from the damper cylinder. The seesaw-like contact lever turns at a speed dependent on the speed at which the actuating knob is moved, and therefore, the stagger actuation times vary with the speed at which the actuating knob is moved.

SUMMARY OF THE INVENTION

One object of the present invention is to provide an operation-staggered dual switch permitting one switching mechanism to be thrown a predetermined time after the other switching mechanism is thrown.

Another object of the present invention is to provide an operation-staggered dual switch, one of switching mechanisms of which dual switch can be easily changed in delayed-operation without any trouble such as scattering of silicone grease.

To attain these objects an operation-staggered dual switch having first and second switching mechanisms installed in its casing, these switching mechanisms being operatively connected so that the operation of the first switching mechanism may follow the operation of the second switching mechanism after a predetermined delay, is improved according to the present invention in that it includes delay means, which comprises a connection rod having indentations formed on one side, a train of toothed wheels, the leading toothed wheel of the train of toothed wheels being engaged with selected indentations of the connection rod, and a rotary damper connected to the trailing toothed wheel, the connection rod being responsive to the start of operation of the first switching mechanism for moving.

With this arrangement the switching mechanism to be thrown later can be easily changed in staggering time without any trouble such as scattering of silicone grease.

The delay means may further comprise resilient means to apply a resilient force to the connection rod, pushing the connection rod against the leading toothed wheel to retain their engagement firmly. With this arrangement the delayed operation can be assured.

Each indentation of the connection rod may have such a shape on one side as to facilitate the separation of the indentation from the counter tooth of said leading toothed wheel. Thus, the connection rod can return to the inoperative position quickly.

At least the first switching mechanism has quick throwing means provided therein, cooperating with the delay means to assure that the first switching mechanism turns on exactly after a predetermined delay.

Each of the first and second switching mechanisms may comprise a seesaw-like contact lever balanced in the middle, and the first and second switching mechanisms may comprise an actuator rod in common for operating their seesaw-like contact levers. The actuator rod may comprise: for each switching mechanism, a hollow retainer having guide slots made on its circumferential wall; and a slidable pusher having guide projections formed on its circumference. The slidable pusher may be contained in the hollow space of the retainer with the guide projections in the guide slots, and may be pushed against the seesaw-like contact lever by a resilient member, which is seated fixedly on the bottom of the hollow retainer. With these arrangements the throwing staggered actuation is stable.

The connection rod may have an elongated aperture made therein; and the switch casing may have a projection formed inside to be put in the elongated aperture of the connection rod, thereby permitting the connection rod to be guided in motion. The elongated aperture and the projection may be positioned in the vicinity of the place at which the connection rod is jointed to the seesaw-like contact lever, and positioned at the same level as the fulcrum of the seesaw-like contact lever. With this arrangement the connection rod can have an increased moment applied thereto in leaving the leading toothed-wheel, so that the train of toothed-wheels may rotate smoothly without being influenced by the repulsive force which is applied thereto via the connection rod on its rear side.

Other objects and advantages of the present invention will be understood from the following description of operation-staggered dual switches according to some preferred embodiments of the present invention, which are shown in accompanying drawings.

DESCRIPTION OF THE PREFERRED EMBODIMENTS

Figure 1:
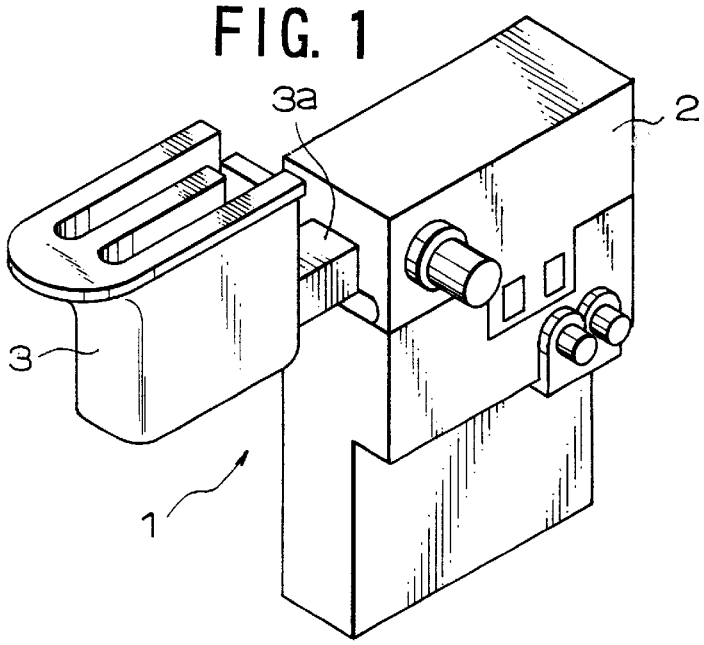
FIG. 1 is a perspective view of an operation-staggered dual switch according to a first embodiment of the invention.

Referring to FIG. 1, an operation-staggered dual switch 1 according to the present invention has an actuating rod 3*a* extending from one side of the switch casing 2. The actuating rod 3*a* has a thumb knob 3 fixed on its end. The actuating rod 3*a* can be slidably moved back and forth in the switch casing 2. The delay switch 1 has main and short-circuit switching mechanisms B and A arranged in parallel.

Figure 2:
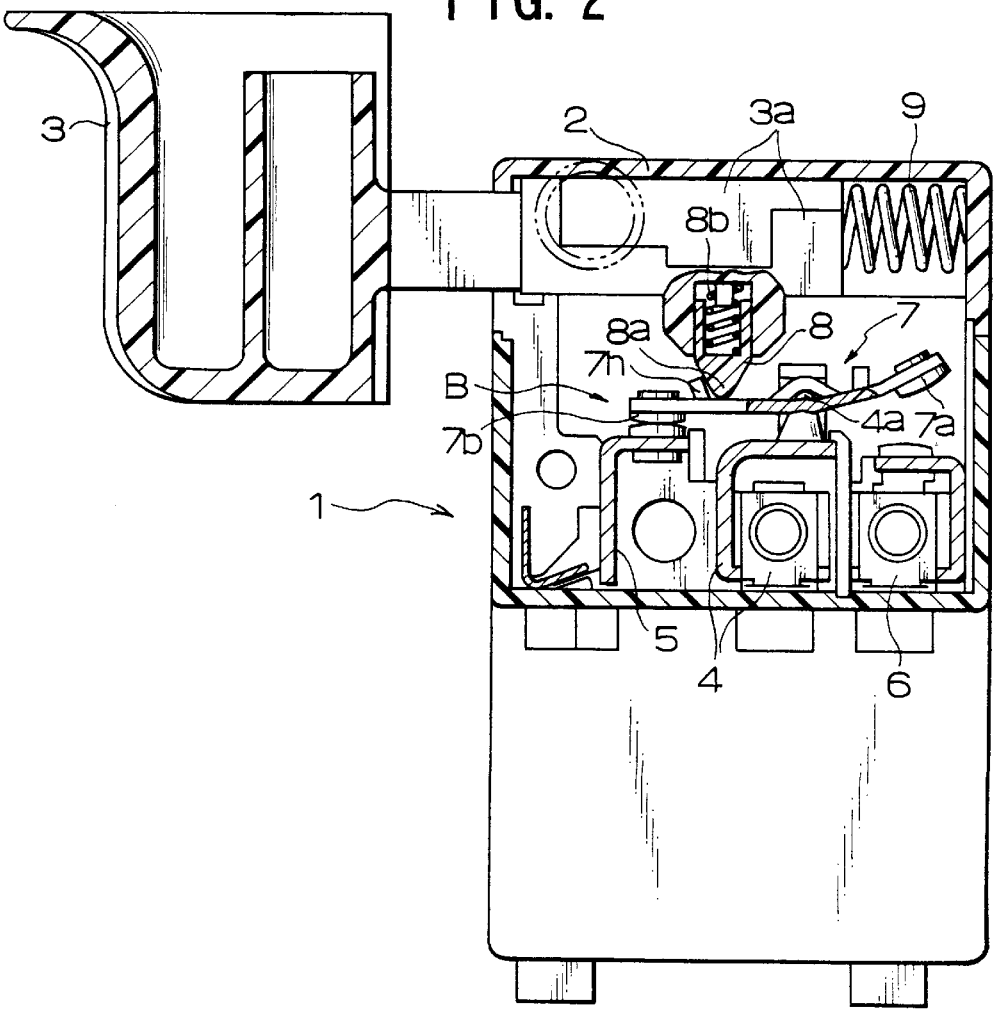
FIG. 2 is a sectional view of the operation-staggered dual switch, showing the main switching mechanism B to be thrown early.

Referring to FIG. 2, the main switching mechanism B has a second common terminal 4 integrally connected to the fulcrum 4*a* on which a seesaw-like contact lever 7 is balanced in the middle, a brake terminal 5 on the left side of the second common terminal 4 for use in short-circuiting and braking an associated electric motor in regenerative mode, and a second power supply terminal 6 on the right side of the second common terminal 4 for connecting the electric motor to an electric power supply.

Figure 3A:
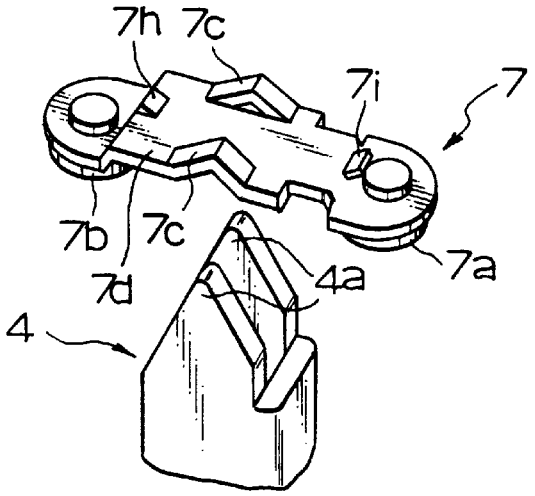
FIG. 3(A) is a perspective view of the seesaw-like contact lever of the main switching mechanism B.

As seen from FIG. 3, the seesaw-like contact lever 7 is supported by the triangular fulcrums 4*a* and 4*a* to be balanced in the middle, and it has a main contact 7*a* and a brake contact 7*b* fixed to its opposite ends, two triangular rises 7*c* formed in the middle on its opposite edges, and two stoppers 7*h* and 7*i* formed inward of the main and brake contacts 7*a* and 7*b*.

As seen from FIG. 2, the actuating rod 3*a* has a slidable pusher 8 spring-biased downward, allowing its pointed projection 8*a* to abut against the flat surface 7*d* of the seesaw-like contact lever 7. The actuating rod 3*a* has a spring 9 fixed to its rear end for permitting the actuating rod 3*a* to return to its initial position when released.

Figure 4:
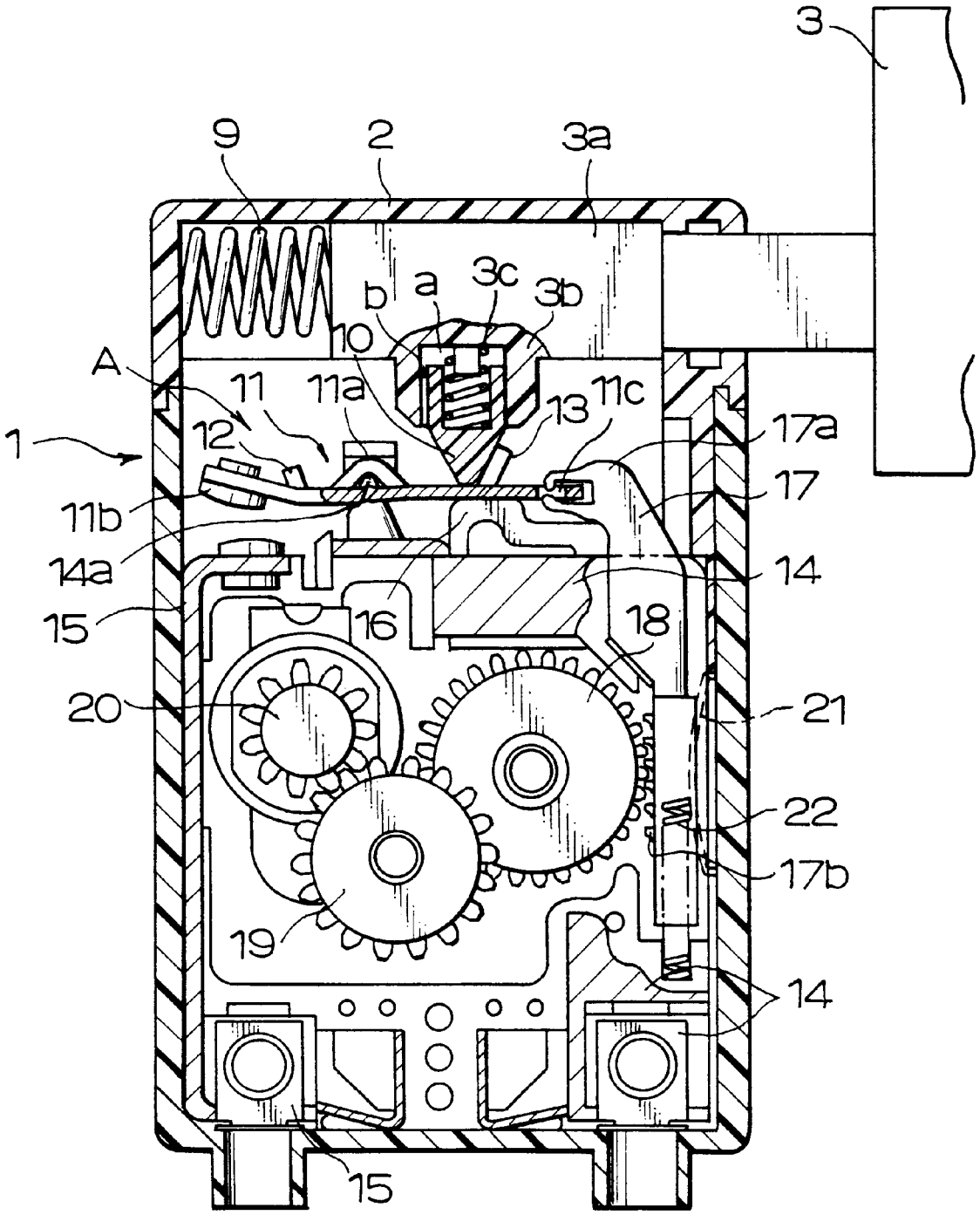
FIG. 4 is a sectional view of the operation-staggered dual switch, showing the short-circuit switching mechanism A.

Referring to FIG. 4, the short-circuit switching mechanism A has a seesaw-like contact lever 11 balanced in the middle, and a slidable pusher 10 is spring-biased downward, allowing its pointed projection to slidably abut against the seesaw-like contact lever 11. As seen from the drawing, the slidable point-ended pusher 10 is loosely fitted in the cavity of the hollow retainer 3*b* of the actuating rod 3*a*, and it is spring-biased downward by a spring 3*c* all the time. The hollow retainer 3*b* has lateral and longitudinal gaps "a" and "b" around the slidable pusher 10.

Figure 3B:
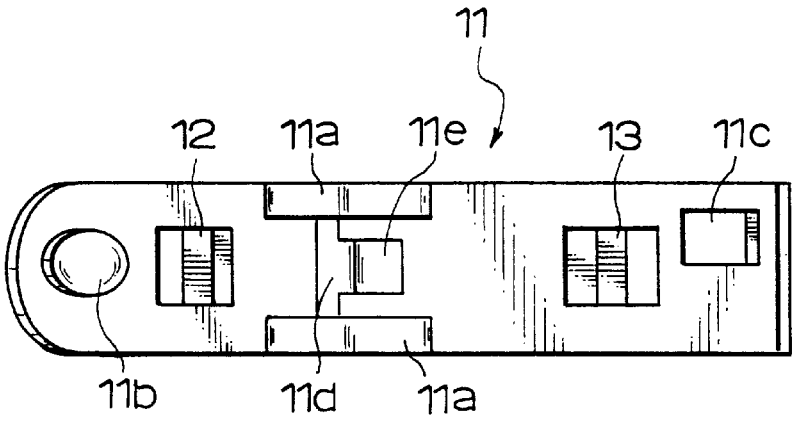
FIG. 3(B) is a plane view of the seesaw-like contact lever of the short-circuit switching mechanism A to be thrown later.
Figure 3C:
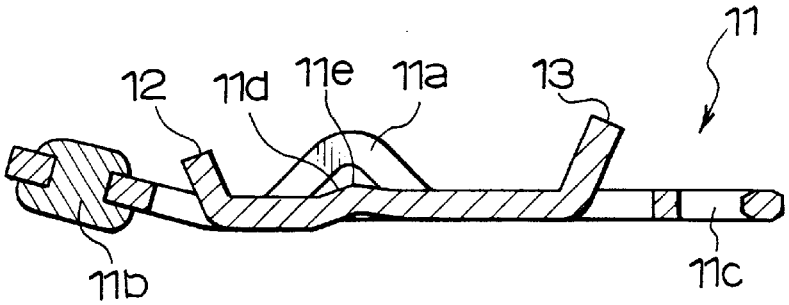
FIG. 3(C) is a longitudinal section of the seesaw-like contact lever of the short-circuit switching mechanism A.

As seen from FIGS. 3(B) and 3(C), the seesaw-like contact lever 11 has a main contact 11*b* and a through hole 11*c* formed at its opposite ends, two triangular rises 11*a* and 11*a* formed in the middle on its opposite edges, two stoppers 12 and 13 formed inward of the main contact 11*b* and the through hole 11*c* for putting the pointed end of the slidable pusher 10 in on- and off positions, and a center ridge-like projection 11*e* formed in the middle of the lever 11. The center ridge-like projection 11*e* has an inclined plane 11*d* on one side.

In FIG. 4, the seesaw-like contact lever 11 is supported by the triangular fulcrums 14*a* and 14*a*, which extend laterally and down to form a first common terminal 14. The first common terminal 14 opens downward to accommodate an electric wire in its outlet. A first power supply terminal 15 is on the left side of the first common terminal 14, opening downward to accommodate an electric wire in its outlet.

On the right side of the pointed fulcrums 14*a* and 14*a* formed is a seat projection 16, which is bossed out of one side wall of the switch casing. The right half of the seesaw-like contact lever 11 rests on the seat projection 16 in the off-position.

In the short-circuit switching mechanism the pointed pusher 10 is loosely fitted in the hollow space of the retainer 3*b* with the laterally and longitudinally gaps "a" and "b" remaining therein, and is spring-biased to the seesaw-like contact lever 11.

When the pointed pusher 10 rides over the center ridge 11*e*, the pointed pusher 10 is inclined on the slope 11*d* of the center ridge 11*e* under the influence of the spring 3*c* so that the pointed pusher 10 may be thrust downward, thereby putting the seesaw-like contact lever 11 in the contact-making position quickly. This quick throwing mechanism is disclosed in the Japanese Patent 7-161897(A), which the application was filed by the same applicant as the present application.

The short-circuit switch A is equipped with delay means for retarding the switching action according to the present invention. Again referring to FIG. 4, the delay means comprises a connection rod 17 (FIG. 5) having indentations 17*b* formed on one side, a leading toothed wheel 18 selectively put in engagement with the indentations of the connection rod 17, an intervenient toothed wheel 19 engaged with the leading toothed wheel 18 (FIG. 6), a trailing toothed wheel 20*a* engaged with the intervenient toothed wheel 19, a rotary damper 20 integrally connected to the trailing toothed wheel 20*a*, and a curved spring plate 21 extending along the rear side of the connection rod 17. The connection rod 17 is operatively connected to the seesaw-like contact lever 11 so that it may rise and descend in response to counter-clockwise and clockwise inclination of the seesaw-like contact lever 11 toward the on- and off-position. The curved spring plate 21 applies a resilient push to the connection rod 17, thereby making it sure that the indentations 17*b* of the connection rod 17 are put in engagement with the leading toothed wheel 18 in response to the rise of the connection rod 17.

As seen from FIG. 4, the connection rod 17 has a forked-and-bracketed end 17*a* fitted in the through hole 11*c* of the seesaw-like contact lever 11. The indentations 17*b* are arranged at regular intervals on one side of the connection rod 17. As best seen from FIG. 5, each indentation has a curved surface on one side, thereby facilitating departure or separation of each indentation from the counter tooth of the leading toothed wheel 18 when the connection rod 17 starts descending (as indicated by arrow C) at the time of transition from the on-position to the off-position, putting the delay means in inoperative position.

Contrarily at the time of transition from the off-position to the on-position, the connection rod 17 is raised upward, and then, the curved spring plate 21 gives a resilient push to the connection rod 17 to put selected indentations in engagement with the leading toothed wheel 18, so that it may rotate.

The connection rod 17 has a coiled spring 22 fixed to its bottom, thereby making it sure that the connection rod 17 is raised upward.

Figure 6:
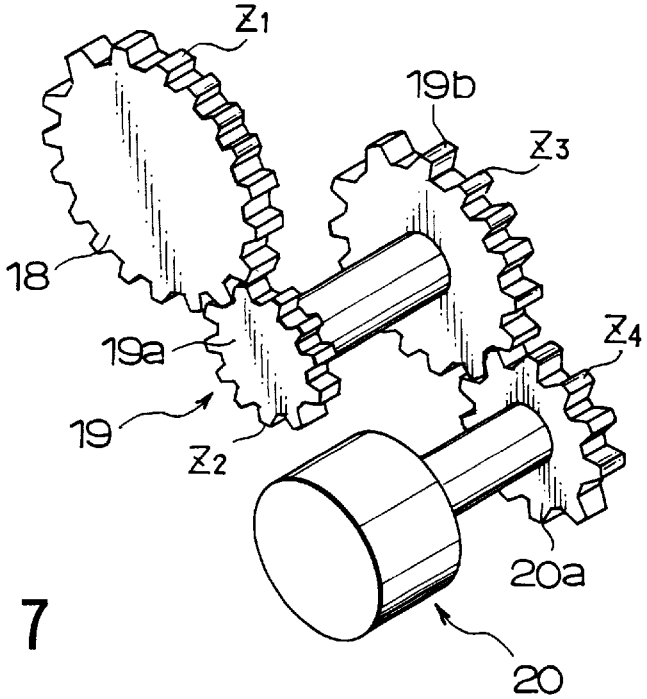
FIG. 6 is a perspective view of a train of toothed-wheels and a rotary damper.

The toothed wheels 18 and 19 are rotatably fixed on the axles, which are fixed to one side wall of the switch casing. The gang of these toothed wheels 18 and 19 and the rotary damper 20 are illustrated in FIG. 6.

Figure 7:
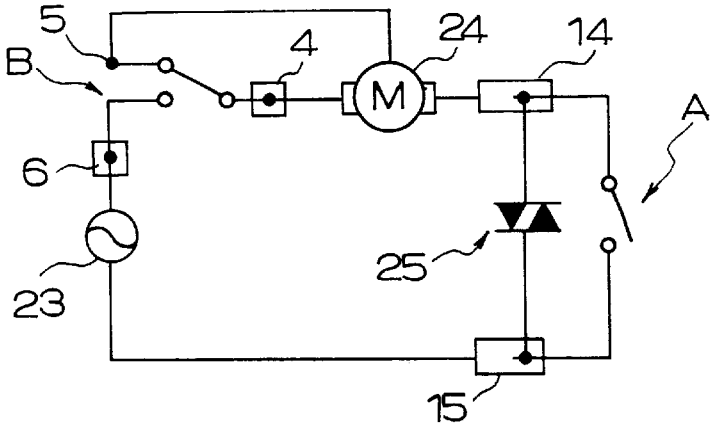
FIG. 7 is a wiring diagram of the operation-staggered dual switch according to the present invention.
Figure 8:
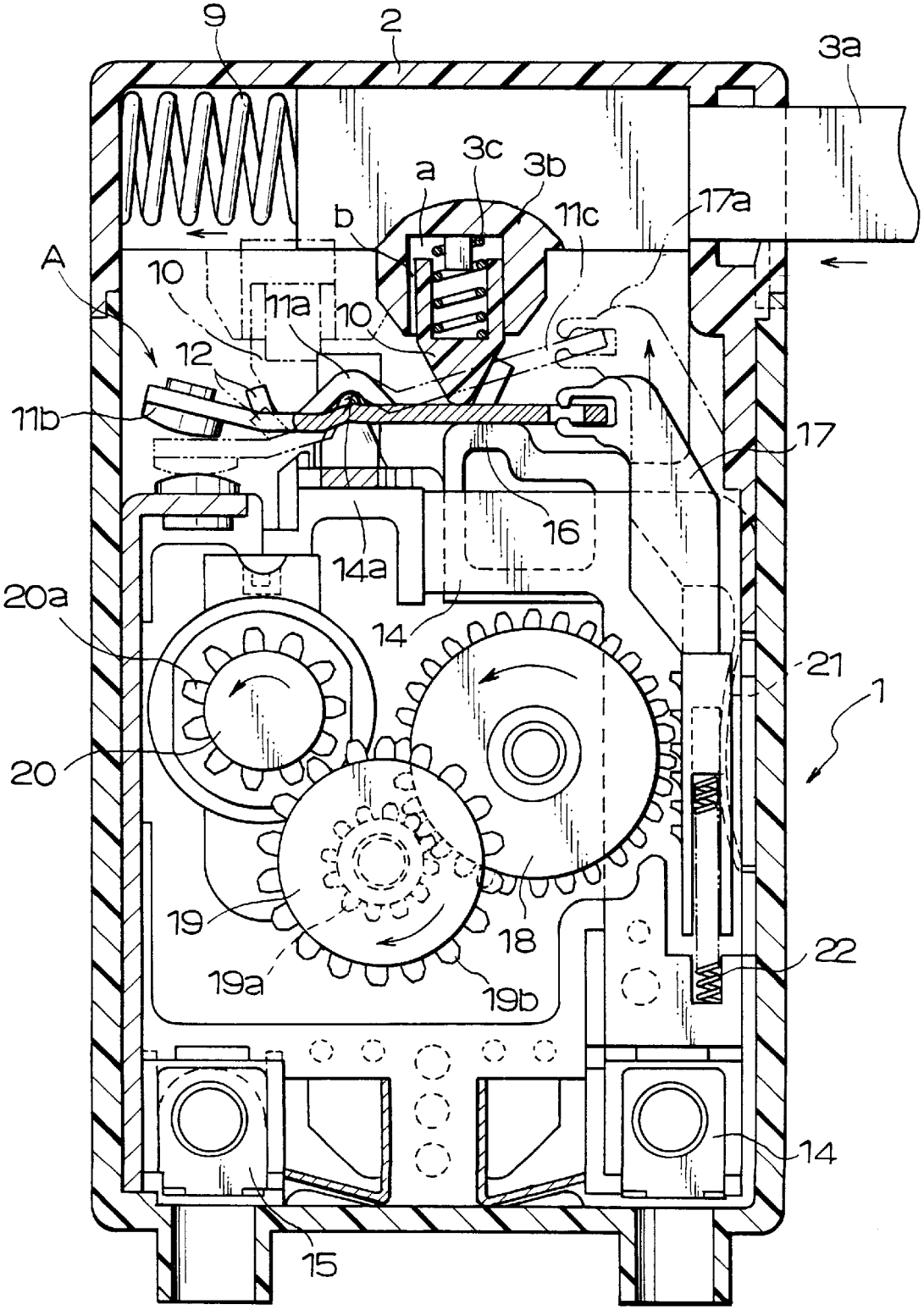
FIG. 8 is a sectional view of the operation-staggered dual switch, illustrating how it turns from off- (phantom lines) to on-position (solid lines)

The wiring diagram of the operation-staggered dual switch comprising a short-circuit switching mechanism A and a main switching mechanism B according to the present invention is shown in FIG. 7. In the drawing an ac power supply is indicated by 23; an electric motor is indicated by 24; and a TRIAC device which is connected across the short-circuit switching mechanism A as an exterior element, is indicated by 25.

In FIG. 2, depression of the thumb knob 3 against the resilient member 9 will cause the pointed end 8*a* of the spring-biased pusher 8 to ride over the center triangular fulcrum 4*a* of second common terminal 4 in the main switching mechanism B, allowing the brake contact 7*b* to depart from the brake terminal 5, and at the same time, allowing the main contact 7*a* to abut on the second power supply terminal 6.

Figure 9A:
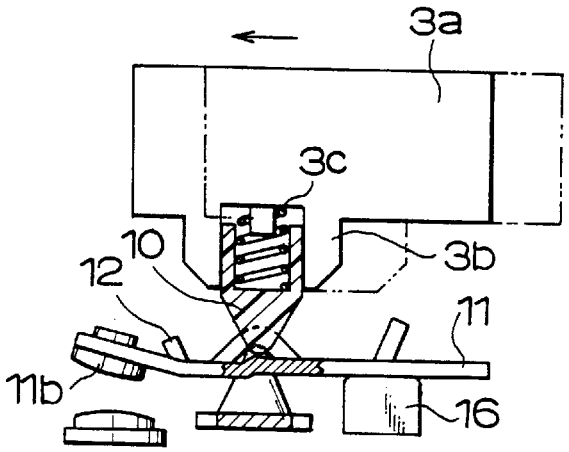
FIGS. 9(A) and 9(B) illustrate how the short-circuit switching mechanism A turns on quickly.
Figure 9B:
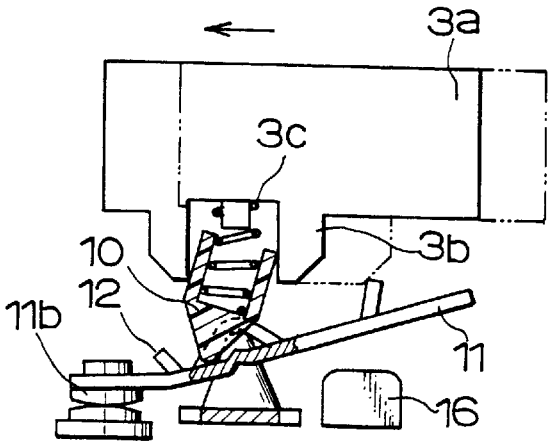

On the other hand, in the short-circuit switch A the advance of the actuating rod 3*a* will cause the pointed pusher 10 to ride over the transverse axis of the center triangular fulcrum 14*a* of first common terminal 14, and then, the pointed pusher 10 is thrust obliquely downward quickly under the influence of the spring 3*c*, thereby permitting the seesaw-like contact lever 11 to be tilted counter-clockwise about the triangular fulcrum 11*a* quickly (see FIG. 4, and FIGS. 9(A) and (B)).

Thus, the rear end of the seesaw-like contact lever 11 rises upward to pull up the connection rod 17 while being pushed against the leading toothed wheel 18 by the curved spring plate 21.

The leading toothed wheel 18, therefore, is rotated counter-clockwise; the relatively small intervenient toothed wheel 19*a*, and the relatively large intervenient toothed wheel 19*b* are rotated clockwise; and the trailing toothed wheel 20*a* and the rotary damper 20 are rotated counter-clockwise.

Thus, the connection rod 17 is loaded with the rotary damper 20, and accordingly the rising speed of the connection rod 17 is lowered, so that the seesaw-like contact lever 11 is tilted slowly to retard the contacting of the main contact 11*b* with the contact of the first power supply terminal 15. The short-circuit switch A, therefore, turns on after the main switch B turns on.

Figure 10:
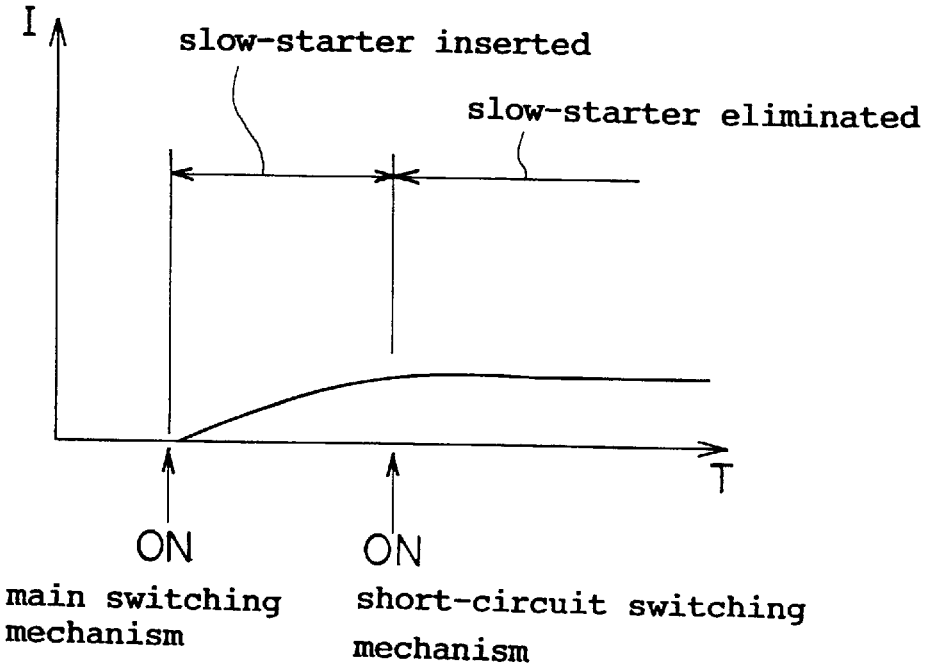
FIG. 10 shows how an operation-staggered dual switch and a slow-starter using a TRIAC suppress the rush current.
Figure 11:
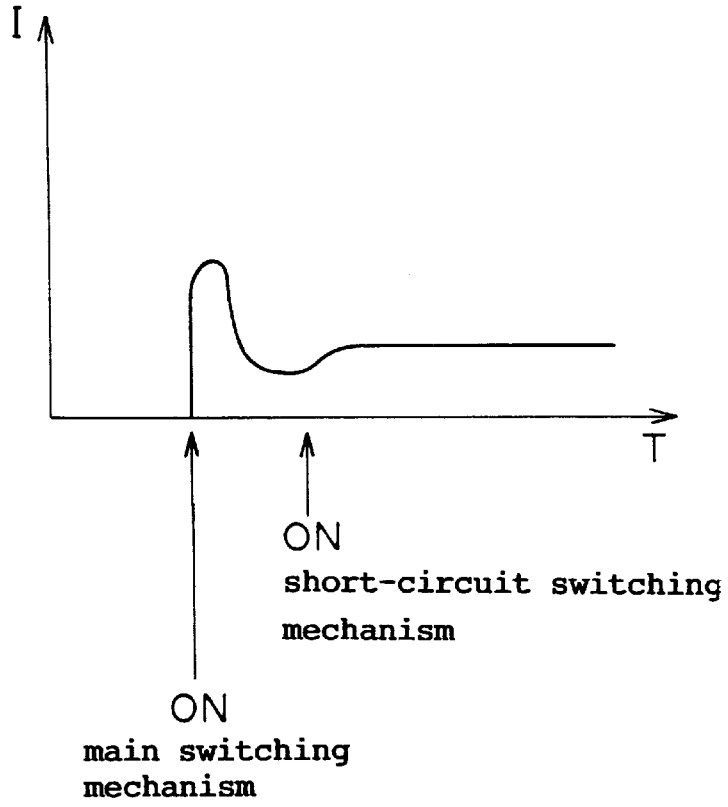
FIG. 11 shows how an operation-staggered dual switch and a resistor in place of the slow-starter suppress the rush current.
Figure 12:
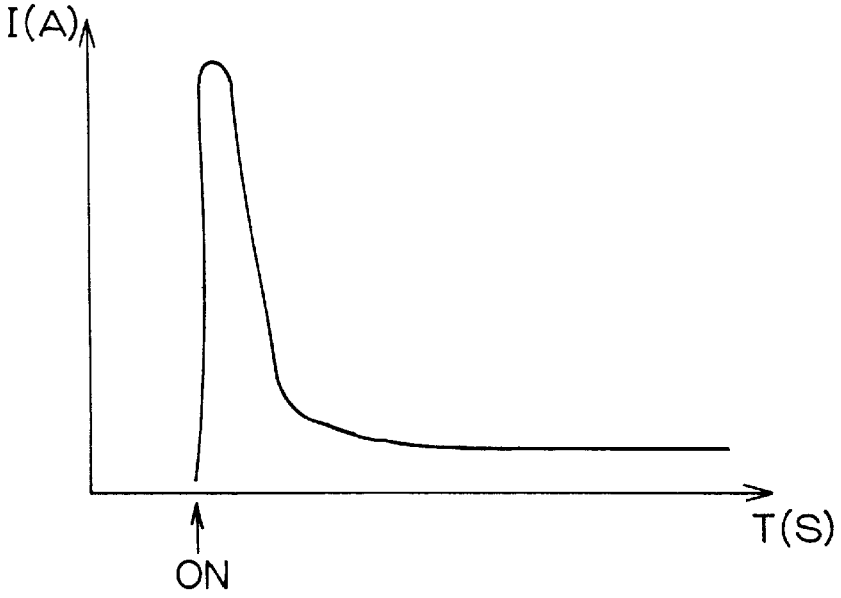
FIG. 12 shows how the rush current varies when an ordinary switch is used.

When a slow-starter circuit using a TRIAC is connected across the short-circuit switching mechanism A, the starting current flowing through an associated motor varies with time as shown in FIG. 10. FIG. 11 shows how the starting current varies with time when the slow-starter circuit uses a resistor in place of the TRIAC.

The loading of the connection rod 17 and the seesaw-like contact lever 11 can be controlled by changing the tooth number ratio of the toothed wheels 18 to 20 and the inertia of the rotary damper 20.

Referring to FIG. 6, the tooth number $Z_3$ of the relatively large toothed wheel 19*b* of the intervenient toothed wheel assembly 19 and the tooth number $Z_4$ of the trailing toothed wheel 20*a* can be changed to control the load, provided that the center-to-center distance S between the relatively large toothed wheel 19*b* and the trailing toothed wheel 20*a* remains constant ($S=m(Z_3+Z_4)/2$; m: module), and that the sum of the tooth number $Z_3$ plus the tooth number $Z_4$ remains constant.

The torque to be applied to the trailing toothed wheel 20*a* will be lowered by increasing the tooth number $Z_3$ and by decreasing the tooth number $Z_4$. Then, the rotary damper 20 is increasingly difficult to be rotated, and accordingly the loading is increased, and the retard in switching action is increased.

The tooth number $Z_1$ of the toothed wheel 18 and the tooth number $Z_2$ of the relatively small toothed wheel 19*a* are related in the same way as described earlier, but the tooth number $Z_1$ of the toothed wheel 18 cannot be changed so much because the leading toothed wheel 18 must be engaged with the indentations of the connection rod 17. To change the loading as required, however, it suffices that the tooth numbers $Z_3$ and $Z_4$ are changed appropriately.

The switching retard can be made as required simply by changing selected toothed wheels and/or by changing the rotary damper without dirtying the surrounding with oil as is the case with the oil damper.

Figure 5:
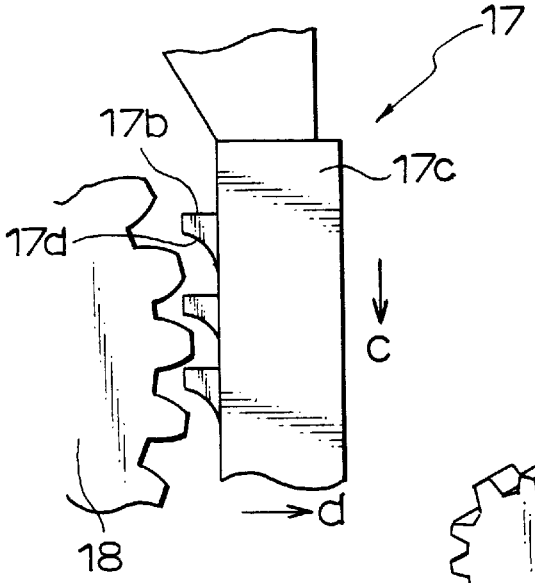
FIG. 5 illustrates how the connection rod is engaged with the leading toothed-wheel.

The curved surface 17*d* of each indentation 17*b* has the effect of allowing the indentation to separate from the counter tooth smoothly in response to the descent of the connection rod 17 in the direction indicated by arrow "c" (see FIG. 5).

Even though the depression and release of the thumb knob 3 is repeated quickly, the seesaw-like contact lever 11 is assured to return to the off-position completely, assuring that it can be put in the on-position exactly in a predetermined time of delay (the difference between the throwing of the main switching mechanism and the throwing of the short-circuit switching mechanism).

The seesaw-like contact lever is equipped with the quick throwing means in the short-circuit switching mechanism A, and therefore, the time length of delay cannot be significantly influenced even though the turning speed of the seesaw-like contact lever changes.

Figure 13:
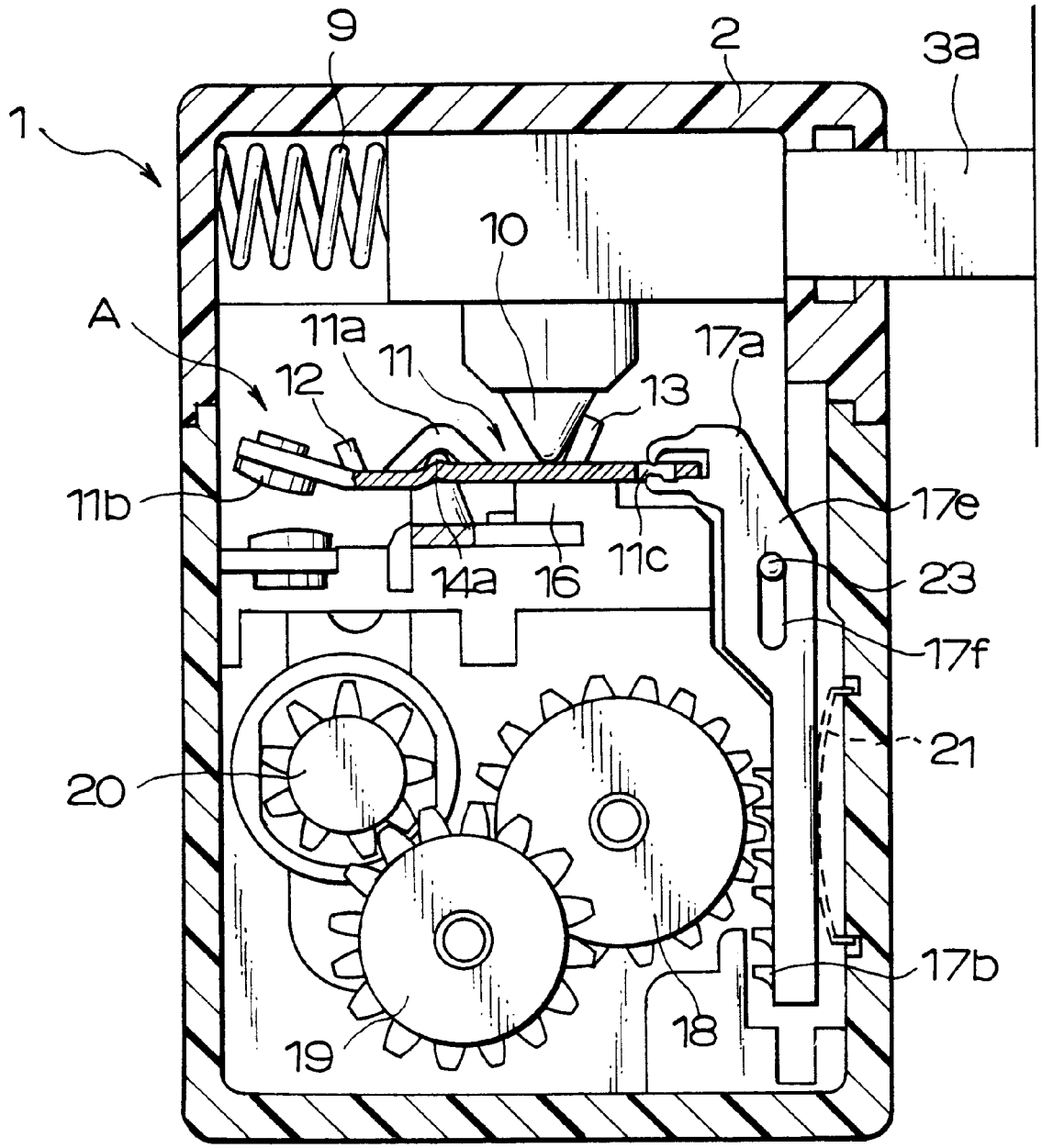
FIG. 13 is a sectional view of an operation-staggered dual switch according to a second embodiment, showing the short-circuit switching mechanism A.
Figure 14:
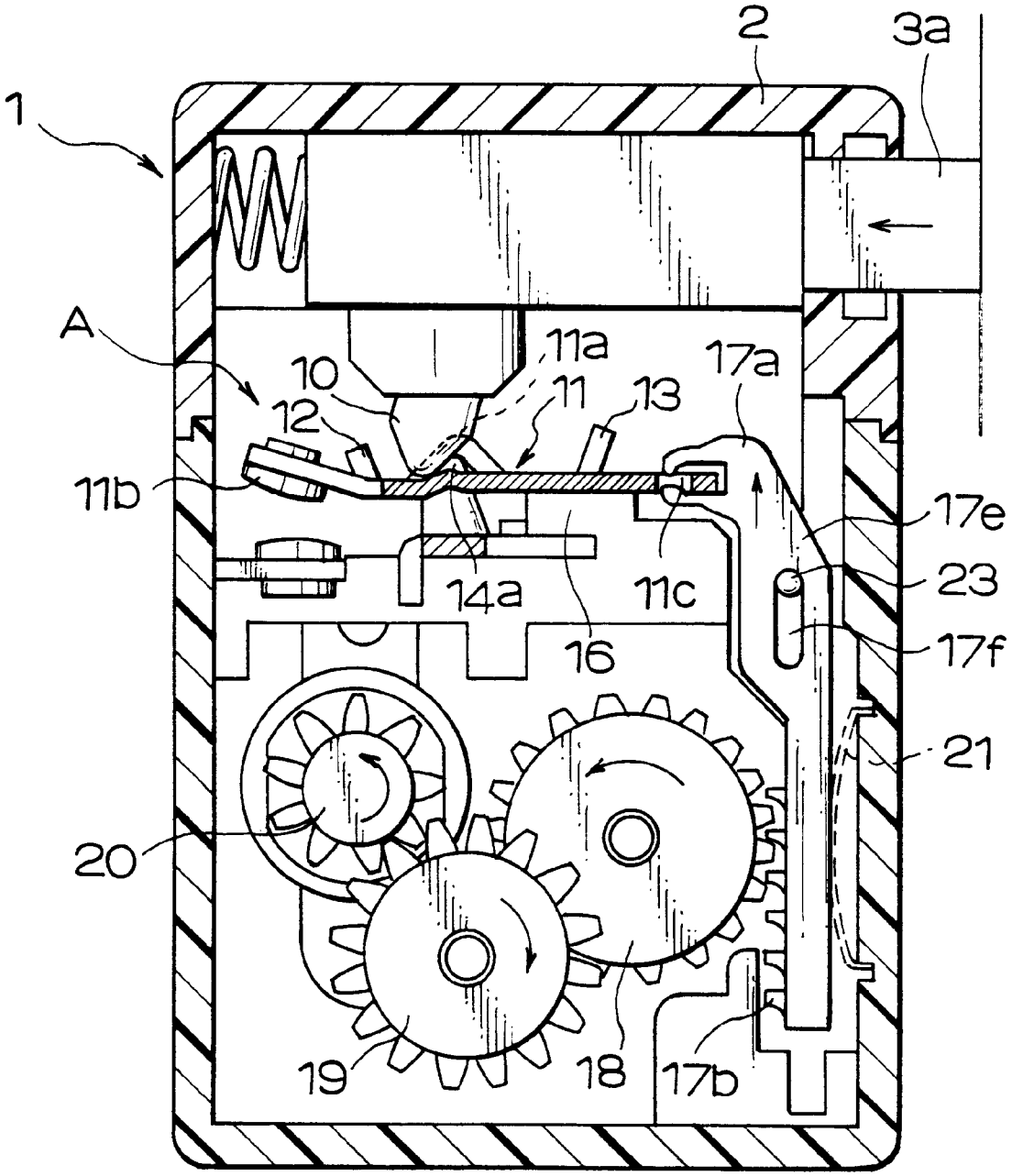
FIG. 14 is a similar sectional view, but showing the short-circuit switching mechanism A on the way to the closing position.
Figure 15:
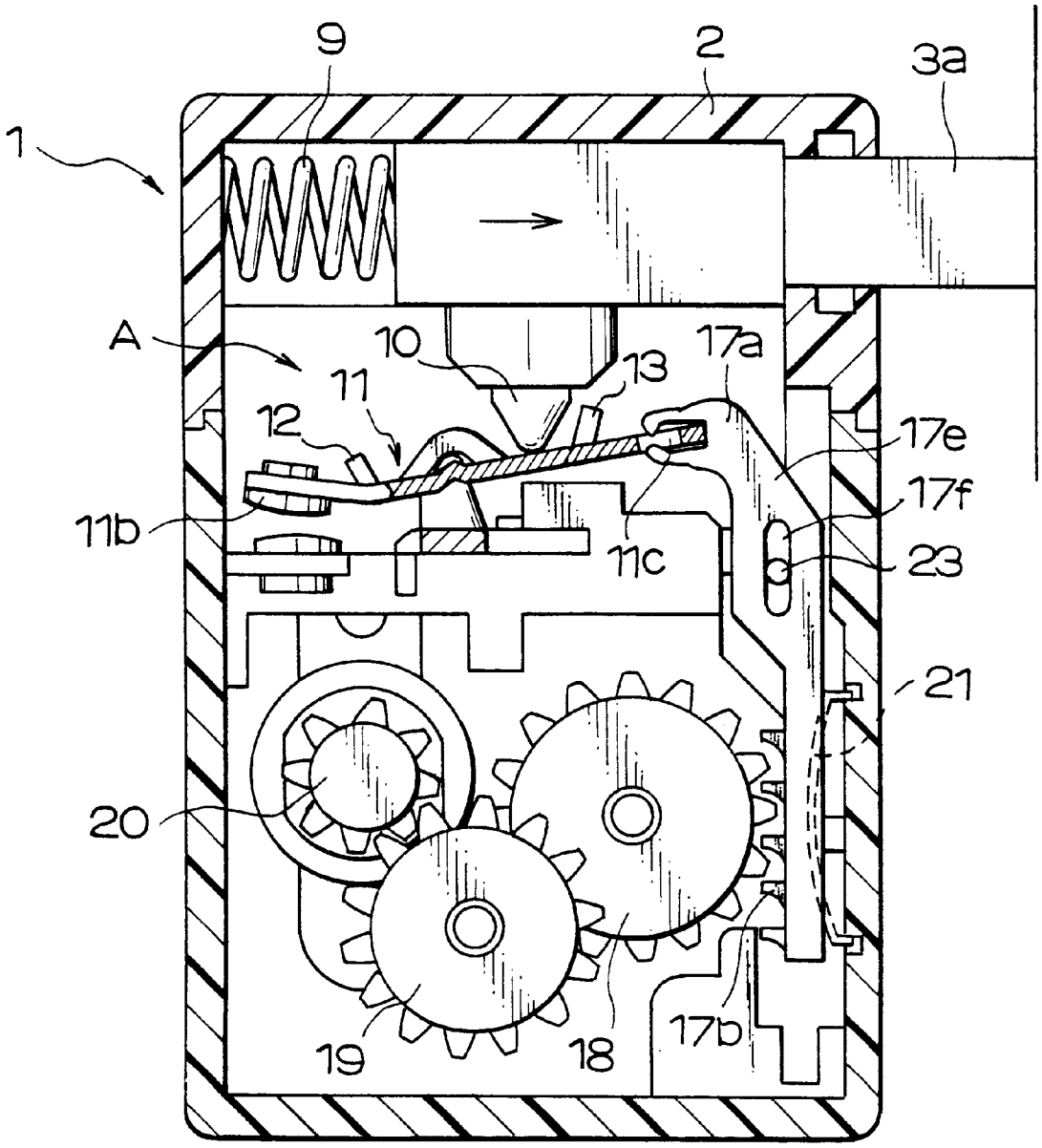
FIG. 15 is a similar sectional view, but showing the short-circuit switching mechanism A on the way to the opening position.

Referring to FIGS. 13 to 15, a modification of connection rod 17 has an elongated aperture 17*f* made between the upper engagement portion 17*a* and the lower indented portion 17*b* of the connection rod 17. A rounded stud 23 projects from one side wall of the switch casing 2. The connection rod 17*e* has no spring fixed to its bottom end.

With this arrangement when the actuating rod 3*a* is depressed (see FIG. 14), the seesaw-like lever 11 is tilted counterclockwise about its fulcrum 11*a* to raise the connection rod 17*e*. Then, the connection rod 17*e* is allowed to rotate clockwise about the rounded stud 23, thus putting the indentations 17*b* positively in engagement with the toothed wheel 18. The toothed wheel 18 is rotated counterclockwise. (see FIG. 14).

When the actuating rod 3*a* is released to put the switching mechanism A in the off-position, an increased moment is applied to the connection rod 17*e* to rotate it counterclockwise about the rounded stud 23, thereby assuring that the connection rod 17*e* is departed from the toothed wheel 18 (see FIG. 15) to expedite the rising of the connection rod 17*e*.

In this second embodiment it is unnecessary to provide the connection rod 17*e* with such a spring 22 as required in the first embodiment, still assuring retard in turning on and descendent of the connection rod 17*e* for the off-position.

Figure 16:
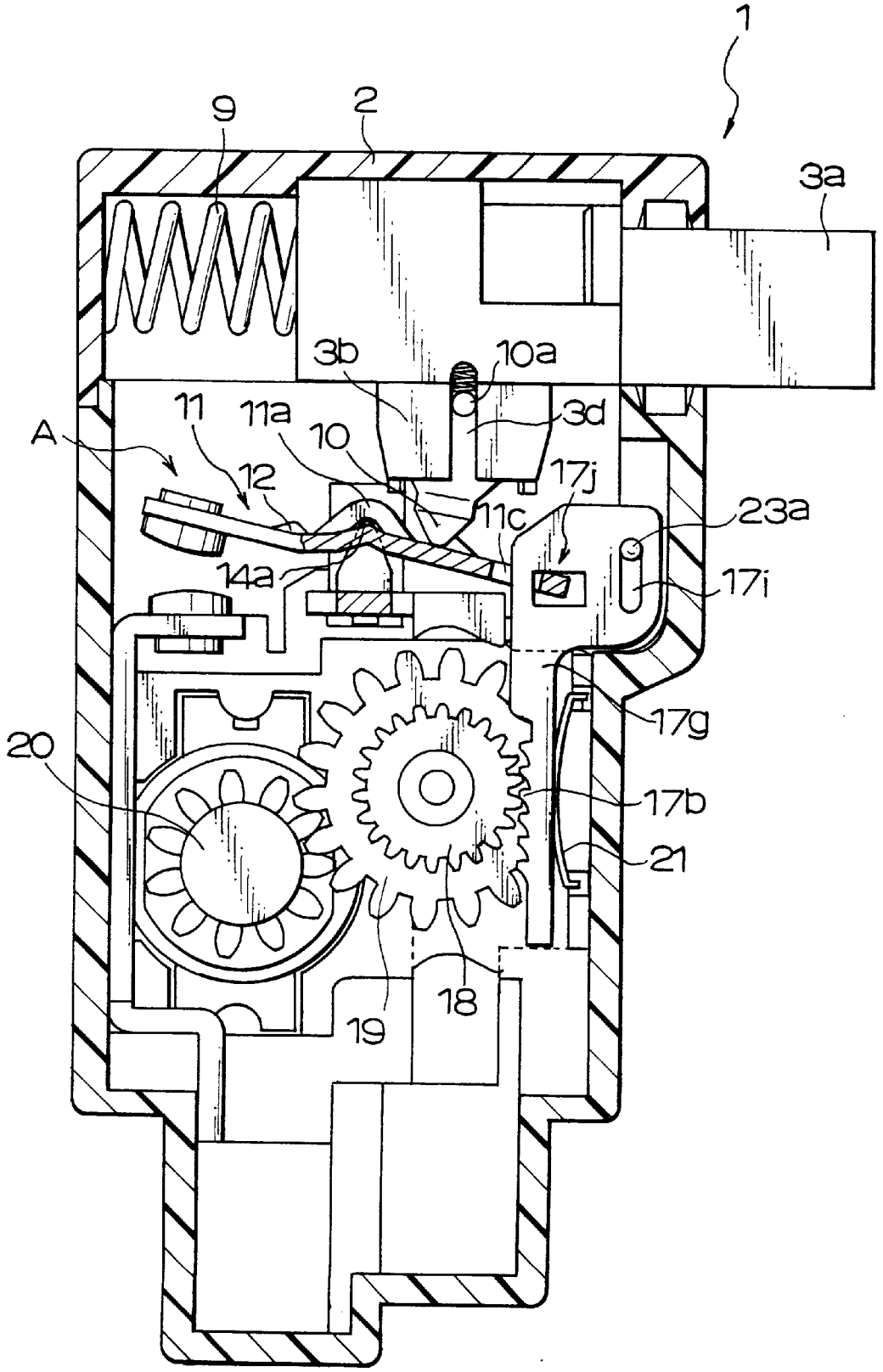
FIG. 16 is a sectional view of an operation-staggered dual switch according to a third embodiment, showing the short-circuit switching mechanism A.

Referring to FIG. 16, the actuating rod 3*a* has a hollow retainer 3*b* formed on its lower side. The hollow retainer 3*b* has a spring-biased pointed pusher 10 loosely fitted therein. The hollow retainer 3*b* has two guide slits 3*d* made on its circumferential wall. These guide slits 3*d* are equal angular distances apart from each other, opening at the lower edge of the circumferential wall of the hollow retainer 3*b*.

The point-ended pusher 10 has two pins 10*a* projecting from its outer circumference. These pins 10*a* are equal angular distances apart from each other, and are slidably fitted in the guide slits 3*d* of the hollow retainer 3*b*. Thus, the point-ended pusher 10 can swing about the opposite pins 10*a*, as seen from FIG. 17. The hollow retainer 3*b* has a recess 3*e* made on its bottom as a seat for the spring 3*c*.

The bottom end of the spring 3*c* is press-fitted in the recess 3*e*, thus permitting the spring 3*c* to stay stable on the bottom of the recess 3*e* when the actuating rod 3*a* is moved back and forth. The point-ended pusher 10, therefore, can swing stable in the hollow space of the retainer. A projection from the bottom of the recess may be used in place of the recessed seat.

Figure 17:
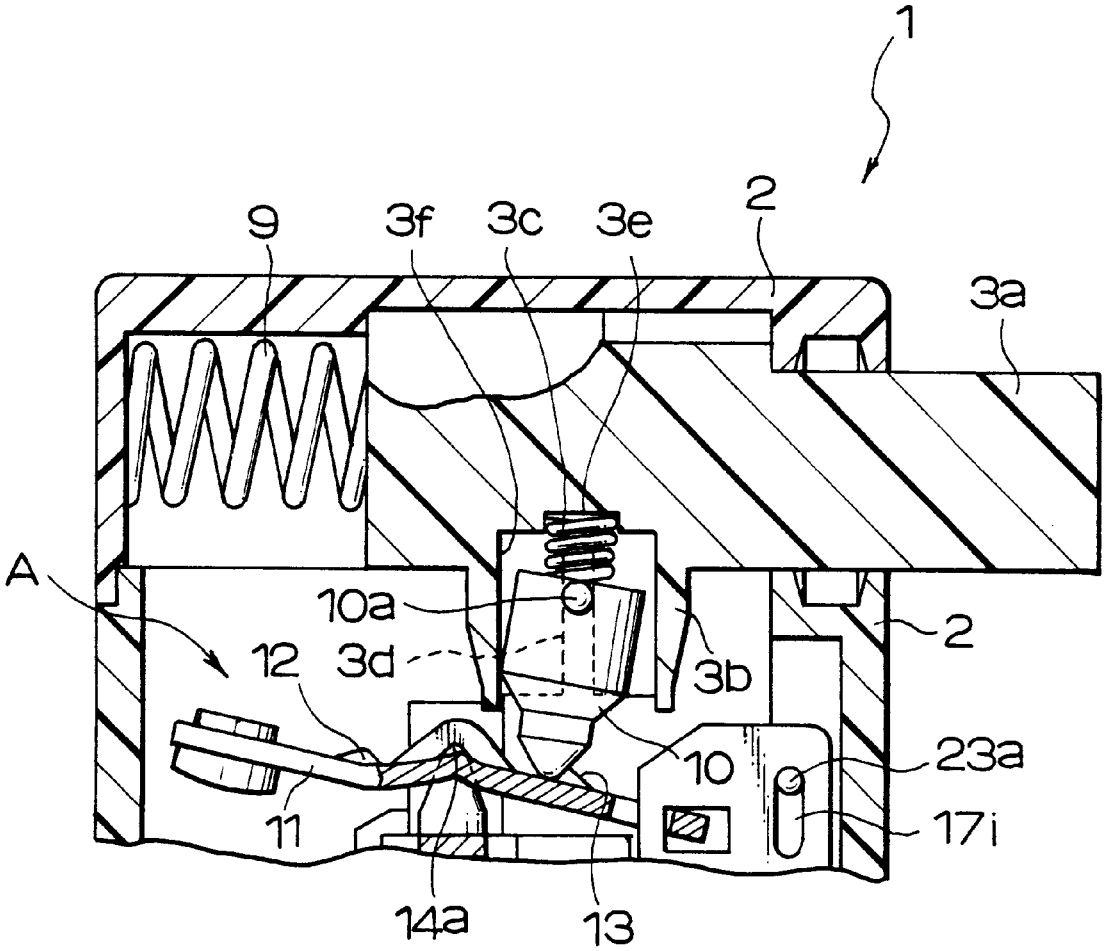
FIG. 17 is a sectional view of the fragment of the operation-staggered dual switch, showing the actuating rod.
Figure 18:
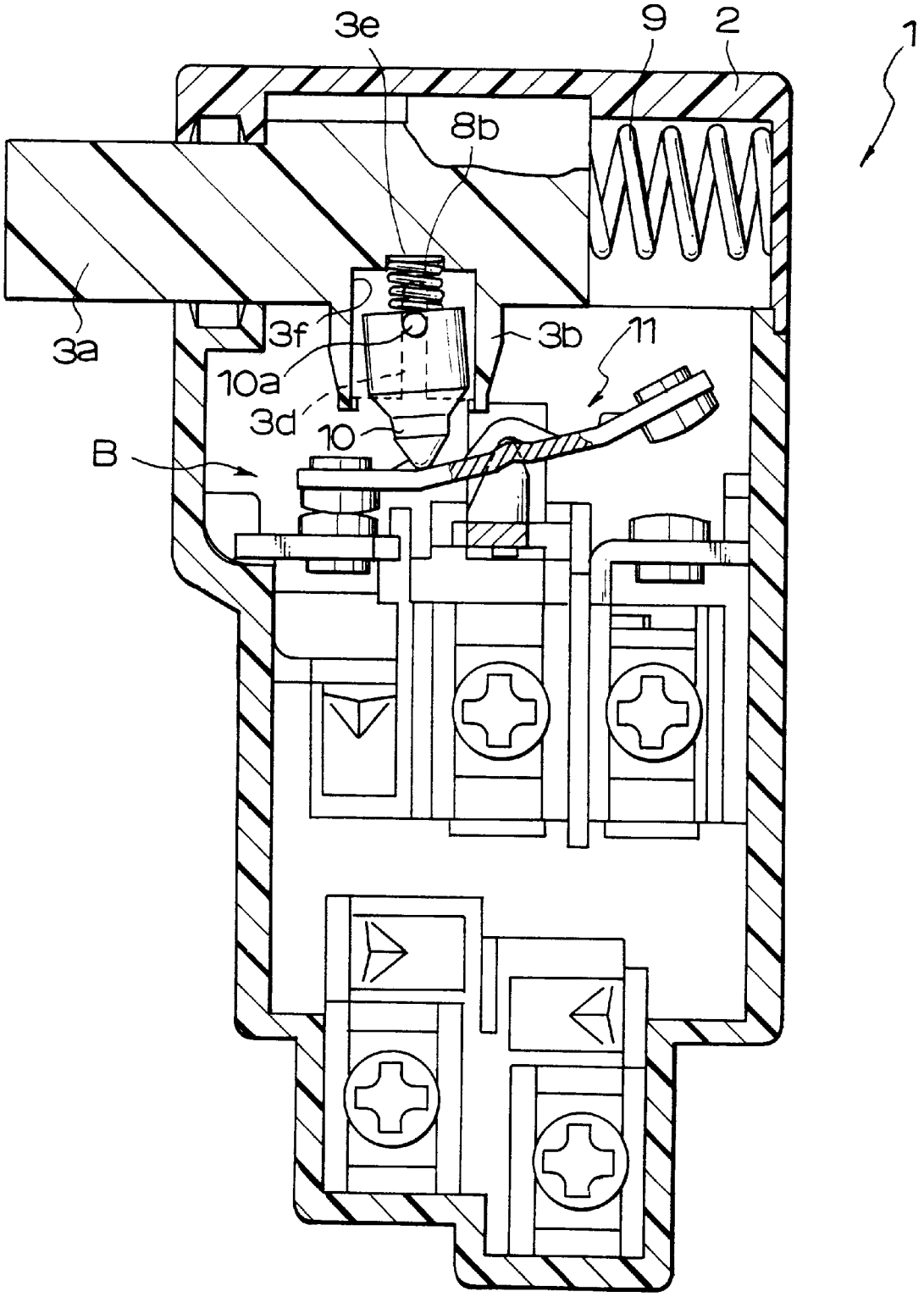
FIG. 18 is a sectional view of an operation-staggered dual switch according to a fourth embodiment, showing the main switching mechanism B.

As seen from FIGS. 16 and 17, the connection rod 17 has an elongated guide aperture 17*i* made in the vicinity of the seesaw-like lever-and-connection rod joint at the same level as the fulcrum of the seesaw-like contact lever 11, thereby increasing the rotary moment to be applied to the connection rod 17 at the instant of departing from the toothed wheel 18 against the counter force exerted by the curved spring plate 21.

The inter distances between adjacent toothed wheels 18 and 19; and 19 and 20*a* are reduced, and accordingly the switch casing is reduced in width.

In the main switching mechanism B the point-ended pusher 10 has guide studs 10*a* formed on its circumference, and the hollow retainer 3*b* has guide slits 3*d* made on its circumference, as is in the short-circuit switching mechanism A.

Assume that the thumb knob 3 is depressed from the off-position as shown in FIGS. 16 and 17. On the side of the short-circuit switching mechanism A: as the actuating rod 3*a* moves forward, the point-ended pusher 10 is tilted rearward (see FIG. 19 (A)); the point-ended pusher 10 is yieldingly raised, climbing the center ridge; and the point-ended pusher 10 is tilted forward after riding over the center ridge (see FIG. 19 (B)). These actions are snapped, and are steady partly because the point-ended pusher 10 is guided by the guide studs 10*a* and guide slits 3*d* in the hollow retainer 3*b*, and partly because the point-ended pusher 10 is steadily pushed against the seesaw-like contact lever 11 by the spring 3*c*, which is seated firmly on the bottom of the hollow retainer 3*e*. Thus, the switching from the off- to on-position can be reproduced for different switch products.

Figure 19A:
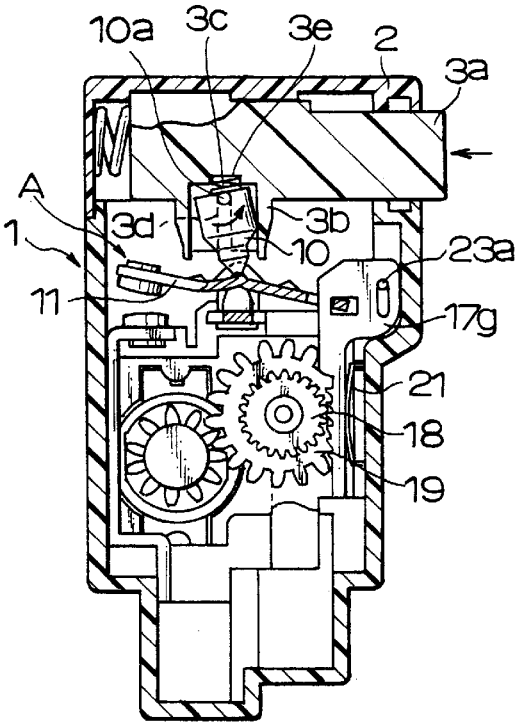
FIGS. 19(A), (B), (C) and (D) are sectional views of an operation-staggered dual switch according to a fifth embodiment, showing how the short-circuit switching mechanism A turns on or off.
Figure 19B:
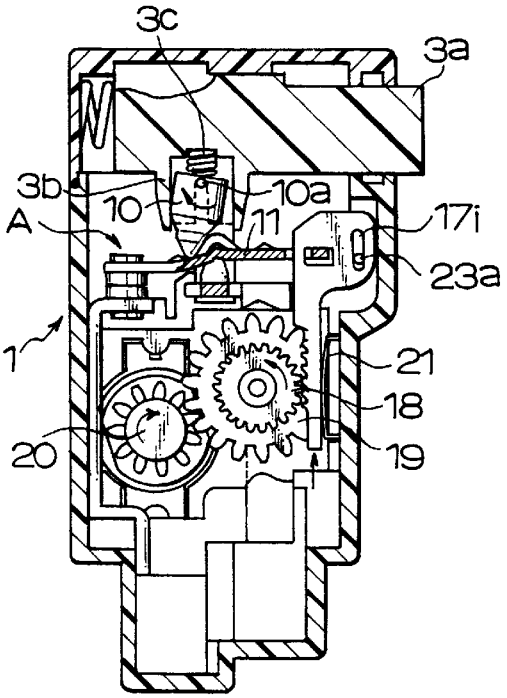
Figure 19C:
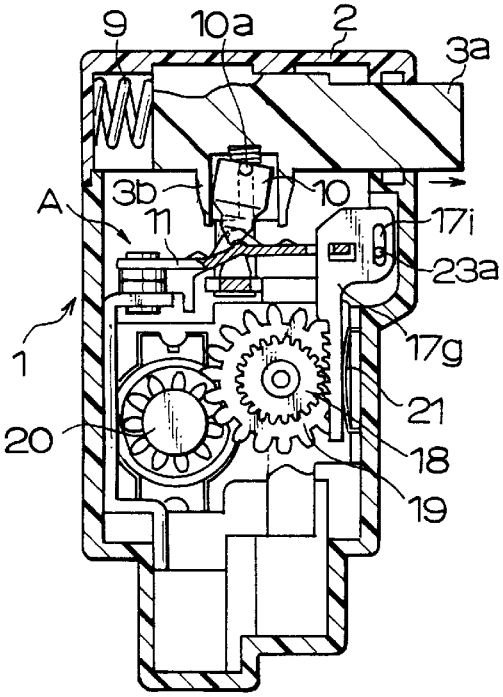
Figure 19D:
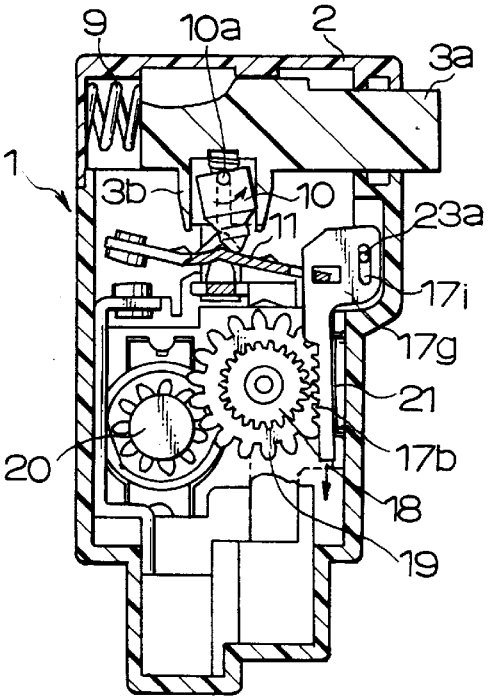

As seen from FIGS. 19(C) and (D), at the time of transition from the on-position to the off-position the connection rod 17*g* is lowered, causing the indentations of the connection rod 17*g* to depart from the toothed wheel 18 (in the direction indicated by arrow "d" in FIG. 5). Then, the rotary torque thus produced about the stud projection 23*a* is increased to be strong enough to overcome the counter resilient force exerted by the curved spring plate 21, thus permitting the indentations of the connection rod 17*g* to depart from the toothed wheel 18 quickly.

Figure 20A:
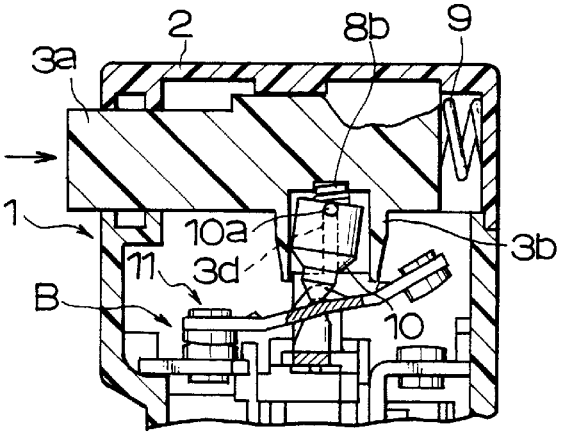
FIGS. 20(A), (B), (C) and (D) are sectional views of an operation-staggered dual switch according to a sixth embodiment, showing how the main switching mechanism B turns on or off.
Figure 20B:
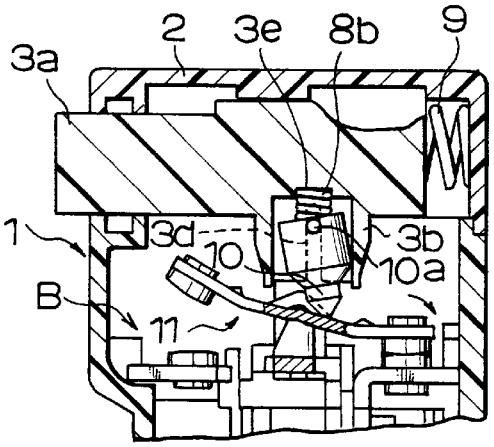
Figure 20C:
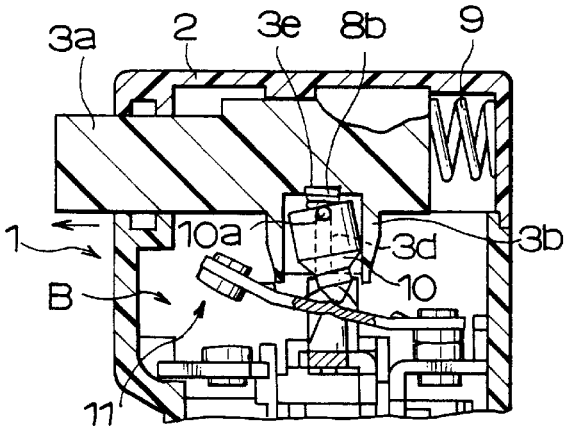
Figure 20D:
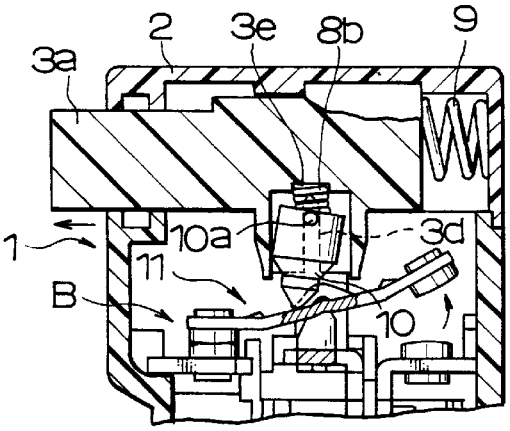

Referring to FIGS. 20(A), (B), (C) and (D), on the side of main switching mechanism, thanks to the steady holding of the spring 8*b* in the hollow retainer 3*b* the point-ended pusher 10 can swing steadily about the spring-biased engagement piece 10*a*, which is firmly fixed to the bottom of the hollow retainer 3*b* via the spring 8*b*. Thus, the reverse of the seesaw-like contact lever can be assured exactly at a controlled time.

What is claimed is:

1. An operation-staggered dual switch having a casing, first and second switching mechanisms installed in the casing, the switching mechanisms being operatively connected such that operation of the first switching mechanism may follow operation of the second switching mechanism after a predetermined delay, wherein said operation-staggered dual switch includes delay means comprising a connection rod having indentations formed on one side, a train of toothed wheels having a leading toothed wheel and a trailing toothed wheel, the leading toothed wheel of the train of toothed wheels being engaged with selected indentations of said connection rod, and a rotary damper connected to the trailing toothed wheel of the train of toothed wheels, said connection rod being responsive to initiation of operation of the first switching mechanism for moving in a given direction.

2. An operation-staggered dual switch according to claim 1 wherein said delay means further comprises resilient means to apply a resilient force to said connection rod, pushing said connection rod against said leading toothed wheel to retain engagement firmly therewith.

3. An operation-staggered dual switch according to claim 2 wherein each of said indentations of said connection rod has such a shape on one side as to facilitate separation of an indentation from an engaging tooth of said leading toothed wheel.

4. An operation-staggered dual switch according to claim 3 wherein at least said first switching mechanism has quick throwing means provided therein, thus cooperating with said delay means to cause an exactly delayed switching.

5. An operation-staggered dual switch according to claim 4 wherein each of said first and second switching mechanisms comprises a seesaw-like contact lever balanced at a fulcrum in the middle, and said first and second switching mechanisms uses a single actuator rod in common for operating the seesaw-like contact levers, the actuator rod comprising: a hollow retainer having guide slots made on a circumferential wall of the hollow retainer; and a slidable pusher having guide projections formed on its circumference, the slidable pusher being contained in a hollow space of the hollow retainer with the guide projections in the guide slots, the hollow space having a cavity with a bottom and the slidable pusher being pushed against the seesaw-like contact lever by a resilient member, which resilient member is seated fixedly on the bottom of the cavity.

6. An operation-staggered dual switch according to claim 5 wherein the connection rod has an elongated aperture made therein; and the switch casing has a projection formed inside to be inserted in the elongated aperture of the connection rod, thereby permitting the connection rod to be guided in motion, the elongated aperture and the projection being positioned proximate the place at which the connection rod is jointed to the seesaw-like contact lever, and being positioned at a same level as the fulcrum of the seesaw-like contact lever.

* * * * *